US009771745B2

(12) United States Patent
Kim

(10) Patent No.: US 9,771,745 B2
(45) Date of Patent: Sep. 26, 2017

(54) CLOSED FORCE TRANSMISSION DEVICE AND SAFETY DOOR LOCK USING SAME

(76) Inventor: Young Hee Kim, Busan-si (KR)

( * ) Notice: Subject to any disclaimer, the term of this patent is extended or adjusted under 35 U.S.C. 154(b) by 277 days.

(21) Appl. No.: 14/379,929

(22) PCT Filed: Mar. 15, 2012

(86) PCT No.: PCT/KR2012/001874

§ 371 (c)(1),
(2), (4) Date: Aug. 20, 2014

(87) PCT Pub. No.: WO2013/125746

PCT Pub. Date: Aug. 29, 2013

(65) Prior Publication Data

US 2015/0042106 A1 Feb. 12, 2015

(30) Foreign Application Priority Data

Feb. 24, 2012 (KR) ..... 10-2012-0019232

(51) Int. Cl.
*E05C 1/12* (2006.01)
*E05C 1/14* (2006.01)
(Continued)

(52) U.S. Cl.
CPC ..... *E05C 1/14* (2013.01); *E05B 63/06* (2013.01); *E05C 1/12* (2013.01); *Y10T 292/096* (2015.04)

(58) Field of Classification Search
CPC ..... Y10T 292/096; Y10T 292/0969; Y10T 292/097; Y10T 292/0971; Y10T 292/0972;
(Continued)

(56) References Cited

U.S. PATENT DOCUMENTS 823,174 A * 6/1906 Jorgenson ..... E05B 55/00 292/170
980,630 A * 1/1911 Granger ..... E05C 1/14 292/170
(Continued)

FOREIGN PATENT DOCUMENTS

CH 225523 A * 2/1943 ..... E05C 1/14
KR 2019970052035 U 9/1997
(Continued)

OTHER PUBLICATIONS

International Search Report for application No. PCT/KR2012/001874 dated Dec. 28, 2012, citing the above reference(s).

*Primary Examiner* — Alyson M Merlino
(74) *Attorney, Agent, or Firm* — Hauptman Ham, LLP

(57) ABSTRACT

The present invention relates to a closed force transmission device in which an insertion depth of a latch bolt inserted into a latch bolt insertion groove can be adjusted to improve safety and components are simplified to allow for ease of assembly and to improve durability. The present invention also relates to a safety door lock using the device. The closed force transmission device of the present invention includes: a cylindrical body housing of which both sides are opened to penetrate a door; a main body slidably arranged within the body housing such that the main body moves in a straight line direction by the force applied from an external source, the main body having at least one tilt surface and a main body movement space formed orthogonally to the straight movement direction in a portion corresponding to the tilt surface.

18 Claims, 11 Drawing Sheets

(51) Int. Cl.
*E05B 63/06* (2006.01)
*E05B 3/00* (2006.01)

(58) Field of Classification Search
CPC ..... Y10T 292/0974; Y10T 292/0975; Y10T 292/0976; Y10T 292/1014; Y10T 292/1015; Y10T 292/1016; Y10T 292/57; E05C 1/12; E05C 1/14; E05C 1/002; E05C 1/08; E05C 1/085; E05B 1/00; E05B 1/0038; E05B 63/06
See application file for complete search history.

(56) References Cited

U.S. PATENT DOCUMENTS 1,021,864 A * 4/1912 Denzler ..... E05B 55/00 292/182
1,209,924 A * 12/1916 Ackley ..... E05C 1/14 292/153
2,960,858 A * 11/1960 Webster ..... E05B 55/005 292/170
3,490,803 A * 1/1970 Rollins ..... E05C 1/14 292/170
3,582,121 A * 6/1971 Rollins ..... E05C 1/12 292/1
5,026,101 A * 6/1991 Dotterweich ..... E05C 1/14 292/166
5,947,535 A * 9/1999 Baker ..... E05C 1/12 292/165
2015/0145266 A1* 5/2015 Song ..... E05B 13/105 292/336.3

FOREIGN PATENT DOCUMENTS

KR 1019990021744 A 3/1999
KR 200160871 Y1 11/1999
KR 1020000074623 A 12/2000
KR 1020120025312 A 3/2012

* cited by examiner

CLOSED FORCE TRANSMISSION DEVICE AND SAFETY DOOR LOCK USING SAME

CROSS REFERENCE TO RELATED APPLICATION

This application claims priority to and the benefit of Korean Patent Application No. 10-2012-0019232 filed in the Korean Intellectual Property Office on Feb. 24, 2012, the entire contents of which are incorporated herein by reference.

TECHNICAL FIELD

The present invention relates to a safety door lock, and more particularly, to a closed force transmission device capable of adjusting an insertion depth of a latch bolt inserted into a latch bolt insertion groove to improve safety and also simplifying construction components thereof to thereby provide excellent assembly productivity and durability, and a safety door lock using the same.

BACKGROUND

Generally, in a door lock, a latch bolt is inserted into a latch bolt insertion groove formed at a door frame, and a locking state is maintained. At this time, an insertion depth of the latch bolt inserted into the latch bolt insertion groove is shallow in about 15 mm. In the case of the door lock having the insertion depth of the latch bolt, the latch bolt may be forcibly separated from the latch bolt insertion groove using a tool such as a screwdriver, and a door may be easily opened. Therefore, a double locking device is required.

If the insertion depth of the latch bolt inserted into the latch bolt insertion groove is deep, for example, in about 20 mm or more, this problem may be solved. However, in a conventional cylindrical or tubular door lock in which a door handle is rotated to open a door, a rotational angle of the door handle is increased, and thus it is inconvenient to open the door.

Meanwhile, in the conventional cylindrical or tubular door lock, while the door handle is rotated, the door should be pushed or pulled to open and close the door. Therefore, in the case of persons with physical handicap and reduced mobility, such as children, patients, and disabled persons, as well as normal persons, it is not easy to open and close the door.

Therefore, a push-pull door lock in which the door handle is pushed or pulled to open and close the door had been proposed to easily open and close the door. However, such a conventional door lock has some problems that a structure thereof is complicated, manufacturing cost is increased due to so many components, and a separate reconstruction work with respect to the door is required when the existing cylindrical or tubular door lock is replaced with the push-pull door lock.

Further, in the conventional door lock, since the insertion depth of the latch bolt inserted into the latch bolt insertion groove may not be increased beyond a predetermined depth, it has low safety, and thus the double locking device may be required.

Furthermore, since the conventional push-pull door locks have different structures from each other, an exclusive door handle is required. Therefore, even if there is a door handle having a design desired by a user, it may not be used if the selected door handle is not suitable for the door lock to be installed.

SUMMARY

The present invention is directed to providing a force transmission device capable of increasing an insertion depth of a latch bolt inserted into a latch bolt insertion groove and thus enhancing safety without a double locking device, and a safety door lock using the same.

Also, the present invention is directed to providing a force transmission device capable of having a simple fabricating process due to a small number of construction components and being installed to an existing door lock without an additional reconstruction work, and a safety door lock using the same.

Also, the present invention is directed to providing a force transmission device capable of using various types of door lock handles including an existing door lock handle and thus having a wide choice of designs, and a safety door lock using the same.

One aspect of the present invention provides a closed safety door lock including a body housing of which both side surfaces are opened in a cylinder shape to pass through a door; a body slidably installed in the body housing to be linearly moved by an external force, and having at least one inclined surface and a body moving space formed at a portion corresponding to the inclined surface to be perpendicular to a linearly moving direction; handles connected with the body through the body housing to respectively protrude outside both side surfaces of the door; and a latch bolt assembly of which one end passes through the body moving space and is coupled to be moved vertically to the moving direction of the body along the inclined surface, and the other end is elastically supported to the body housing to be interlocked with the linear movement of the body and thus to be moved vertically to the moving direction of the body.

The body and the latch bolt assembly may be returned to their original positions when the external force applied to the body is released.

The latch bolt assembly may include a connecting shaft movably installed to pass through the body and the body housing; a slider coupled to one side of the connecting shaft to be moved in an axial direction of the connecting shaft while being in contact with the inclined surface at the time of a linear movement of the body and thus to move the connecting shaft in a direction vertical to the moving direction of the body; an elastic body configured to elastically support the other side of the connecting shaft and to return the body and the latch bolt assembly to their original positions when the external force applied to the body is released; and a latch bolt installed at an end of the other side of the connecting shaft to reciprocate in the axial direction of the connecting shaft according to a restoring force of the elastic body and to maintain a locked or unlocked state of the door.

A cross section of the body moving space may have a circular or rectangular shape, a width thereof may be greater than a diameter of the connecting shaft, and a length thereof may be formed to be twice or more of a displacement of the connecting shaft.

The inclined surface may be formed into a single inclined surface or one pair of inclined surfaces opposed to each other, and one ends thereof may be in contact with each other to form a predetermined angle.

The pair of inclined surfaces may be formed in a V-shaped cut-away groove or a reversed V-shaped protrusion.

The single inclined surface may form an angle of 15 to 75°, and the pair of inclined surfaces may form an angle of 30 to 160°.

A portion of the slider, which is in contact with the inclined surface, may be formed in an arc shape.

The displacement of the connecting shaft may be in inverse proportion to an inclined angle of the inclined surface, and may be in proportion to a height between an initial position and an apex position of the inclined surface of the body.

The safety door lock may further include a latch case configured to simultaneously receive the latch bolt therein when the elastic body is contracted in a state of receiving the elastic body.

The body moving space of the body may include a first body moving space formed in a slot shape to be parallel with a sliding movement direction in the body housing; and a second body moving space formed to be connected with the first body moving space, formed in the slot shape to be inclined with respect to a sliding movement direction in the body housing, and of which an inner surface is used as the inclined surface.

The body may include a first surface connected with a first handle; a second surface opposite to the first surface and connected with a second handle; a third surface adjacent to the first and second surfaces; a fourth surface opposite to the third surface; a fifth surface adjacent to the third and fourth surfaces; and a sixth surface opposite to the fifth surface, and the first body moving space may be formed to vertically pass through the third and fourth surfaces, and the second body moving space may be formed to pass through the fifth and sixth surfaces.

The second body moving space may be formed in a linear shape.

The body may include a main body in which the body moving space is formed and which is connected with the first handle; and a subsidiary body integrally formed with the main body and connected with the second handle.

The latch bolt assembly may switch the door into a locked or unlocked state when the latch bolt assembly is located at both ends of the second body moving space.

The second body moving space may have at least one curved portion.

Both ends of the first and second body moving spaces may be substantially the same.

The latch bolt assembly may include a slider installed at the second body moving space of the body to be moved along the second body moving space, and having a coupling hole formed at a portion in which the first and second body moving spaces are crossed; a connecting shaft movably installed to pass through the body and the body housing, installed to pass through the first body moving space of the body, and fixed to the coupling hole of the slider; an elastic body configured to elastically support the other side of the connecting shaft and to provide a restoring force to return the body and the latch bolt assembly to their original positions when the external force applied to the body is released; and a latch bolt installed at an end of the other side of the connecting shaft to reciprocate in an axial direction of the connecting shaft according to the restoring force of the elastic body and to maintain a locked or unlocked state of the door.

The slider may include a slider rod in which the coupling hole is formed; and one pair of bearings coupled to both ends of the slider rod and moved along the inclined surface of the second body moving space of the body.

Another aspect of the present invention provides a closed force transmission device including a body slidably installed in a body housing to be linearly moved by an external force, and having at least one inclined surface and a body moving space formed at a portion corresponding to the inclined surface to be perpendicular to a linearly moving direction; and a latch bolt assembly of which one end passes through the body moving space and is coupled to be moved vertically to a moving direction of the body along the inclined surface, and the other end is elastically supported to the body housing to be interlocked with the linear movement of the body and thus to be moved vertically to the moving direction of the body.

Therefore, the present invention can adjust the insertion depth of the latch bolt inserted into the latch bolt insertion groove to thereby enhance the safety without the double locking device, can have the simple fabricating process due to the small number of construction components, and also can have excellent durability.

Further, the present invention can be installed at the existing door in use without the additional reconstruction work and also can use handles having various types and colors, as well as the conventional door handle, thereby providing esthetic properties.

DETAILED DESCRIPTION

In the following description, detailed descriptions of well-known functions or constructions will be omitted since they would obscure the invention in unnecessary detail.

It should be understood that the terms used in the specification and the appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

Hereinafter, exemplary embodiments of the present invention will be described in detail.

Figure 1:
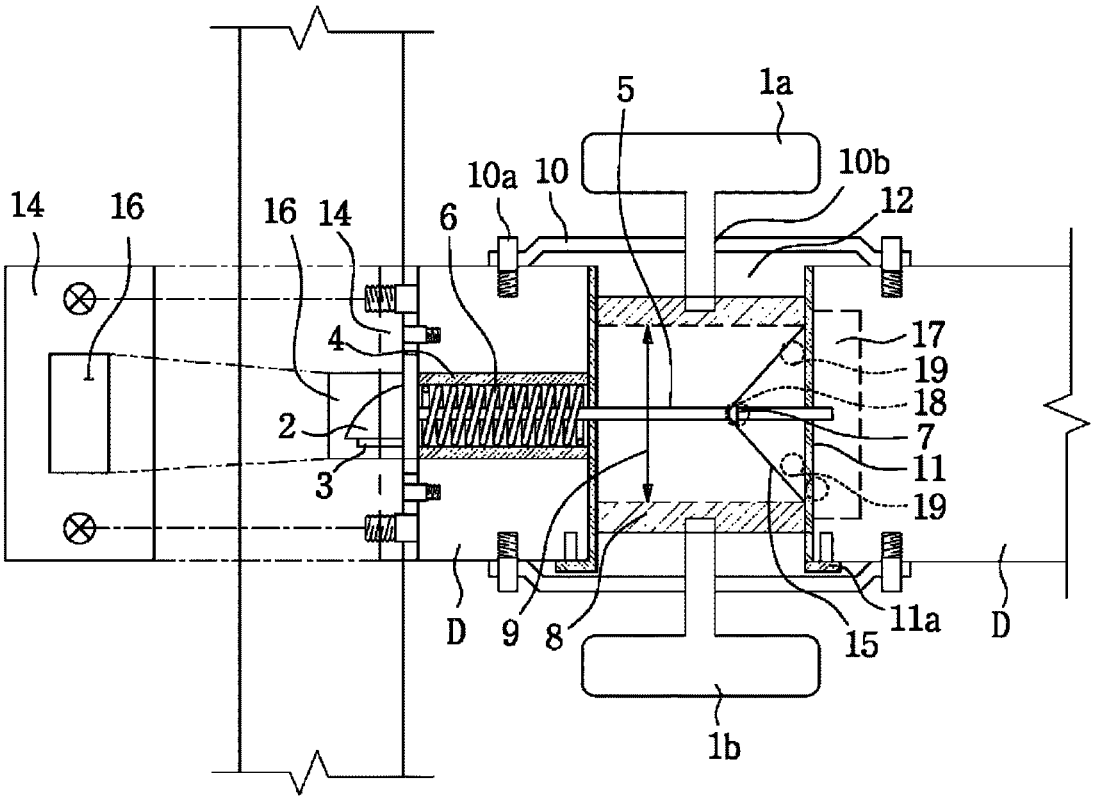
FIG. 1 is a schematic view illustrating a state in which a safety door lock according to a first embodiment of the present invention is closed.
Figure 2:
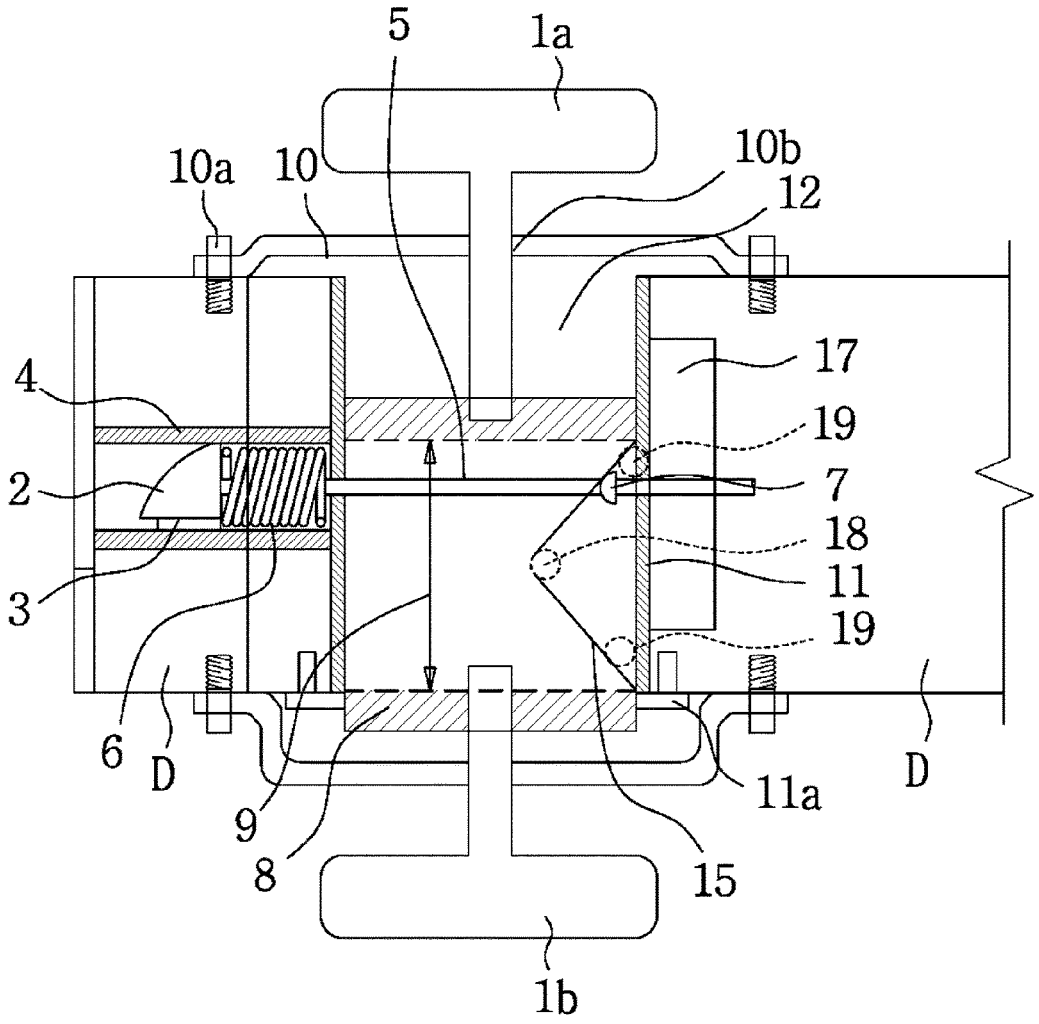
FIG. 2 is a schematic view illustrating a state in which the safety door lock of FIG. 1 is opened.
Figure 3:
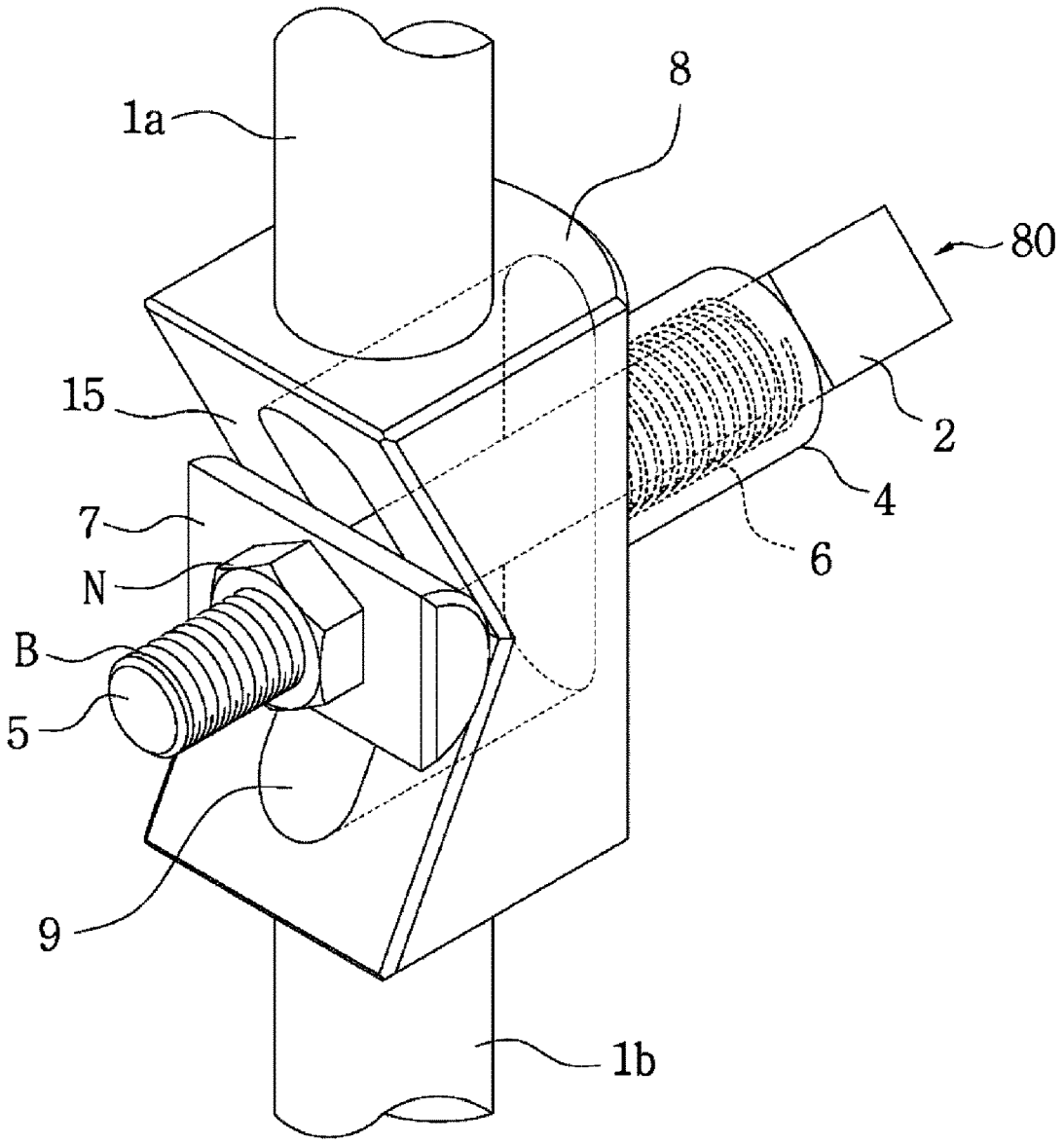
FIG. 3 is a perspective view illustrating a state in which a force transmission device according to the first embodiment of the present invention is assembled.

FIG. 1 is a schematic view illustrating a state in which a safety door lock according to a first embodiment of the present invention is closed, FIG. 2 is a schematic view illustrating a state in which the safety door lock of FIG. 1 is opened, and FIG. 3 is a perspective view illustrating a state in which a force transmission device according to the first embodiment of the present invention is assembled.

Referring to FIGS. 1 to 3, a door lock includes a force transmission device and handles 1*a* and 1*b* installed at a door D. The force transmission device includes a body 8 and a latch bolt assembly 80, and may further include a body housing 11.

The door lock includes the body housing 11 of which both side surfaces are opened in a direction that a through-hole 12 passing through both side surfaces of the door D is formed, the body 8 configured to reciprocate in the body housing 11 by pushing or pulling the handles 1*a* and 1*b* and having an inclined surface 15 formed to be slidable with respect to a slider 7, the handles 1*a* and 1*b* installed to be connected with the body 8 via the body housing 11 and to protrude outside the both side surfaces of the door D, and the latch bolt assembly 80 interlocked with a reciprocating motion of the body 8, inserted vertically to a lengthwise direction of the body 8 so as to convert a reciprocating direction of the body 8 into a vertical direction, and moved along the lengthwise direction of the body 8.

The latch bolt assembly 80 includes the slider 7 coupled to one end of a connecting shaft 5 passing through the body 8 to be moved in an axial direction of the connecting shaft 5 while being in contact with the inclined surface having a V-shape groove at the time of a linear motion of the body and to move the connecting shaft 5 in a direction vertical to a moving direction of the body, the connecting shaft 5 installed to be connected with the slider 7 and to linearly reciprocate vertically to the linear reciprocating motion of the body 8, a latch bolt 2 installed at one end of the connecting shaft 5 to be inserted into or separated from a latch bolt insertion groove 16 according to a reciprocating motion of the connecting shaft 5, and an elastic body 6 contracted by a movement of the connecting shaft 5 when an external force is applied in a direction in which the door D is opened, and configured to move and return the connecting shaft 5 in a reverse direction by a returning force when the external force is released. At this time, the elastic body 6 may be installed at at least one of both ends of the connecting shaft 5 on an outer surface of the body housing 11 to be coupled with the latch bolt 2. Meanwhile, the first embodiment describes an example in which the elastic body 6 is installed on the outer surface of the body housing 11. However, the elastic body 6 may be installed between an inner surface of the body housing 11 and the inclined surface 15 of the body 8.

Further, the latch bolt assembly 80 includes a latch case 4 formed to receive the latch bolt 2 in a state of receiving the elastic body 6.

A body moving space 9 having, for example, an oval or rectangular cross sectional shape vertical to the axial direction of the connecting shaft 5 is formed at a center portion of the body 8, and the connecting shaft 5 reciprocates vertically to the moving direction of the body 8 while being maintained in a state of passing through the body moving space 9. That is, the body moving space 9 means a space in which the body 8 is moved along the connecting shaft 5.

Further, a connecting shaft guide 17 is formed at the door to prevent shaking of the connecting shaft 5 and to stably reciprocate the connecting shaft 5, when the connecting shaft 5 reciprocates vertically to the moving direction of the body 8.

The handles 1*a* and 1*b* may have a round bar shape, an oval bar shape, or other polygonal shapes, and handles used in the conventional door lock may be used. For example, the handles 1*a* and 1*b* is assembled to or disassembled from the body 8 through a male screw (not shown) formed in the part toward the body 8 and a female screw (not shown) formed at the body 8. Herein, shapes, materials, and colors of the handles 1*a* and 1*b* may be selected variously in terms of convenience or design, as long as the handles 1*a* and 1*b* may push or pull the body 8.

When the handle 1*a* is pushed or pulled, the body 8 reciprocates along an inner side of the body housing 11 installed inside the through-hole 12 in both directions, and the handle 1*a* passes through a holder 10, and the holder 10 is fixed to the door D by a holder fixing means 10*a*.

In the case of the conventional push-pull door lock, the handle performs a complex motion in an up and down direction and a horizontal direction with respect to a door surface, and a reciprocation motion of the handle is transferred to the latch bolt through multiple components, and thus the conventional push-pull door lock has a complicated structure. However, in the door lock of the present invention, the handle is moved in only one direction vertical to the door surface, and the reciprocating motion of the handle 1*a* is directly transferred to the latch bolt 2 through the body 8 on which the handle 1*a* is installed, and thus the number of construction components is small.

The body housing 11 is installed in the through-hole 12 formed to pass through the both surfaces of the door D and also installed to a predetermined length, such that the body 8 reciprocates along an inner wall of the body housing 11 by the external force which pushes or pulls the handles 1*a* and 1*b*. At this time, the body housing 11 may have various cross sectional shapes such as a circle, an oval, or a polygon. When considering ease of fabrication, it is preferable to have a circular cross sectional shape or a rectangular cross sectional shape.

Meanwhile, as illustrated in FIG. 1, the body housing 11 is machined in a "ㅁ"-shape toward an indoor side, and fixed to the door D through a body housing fixing means 11*a*, and thus the body 8 may easily reciprocate along the inner wall of the body housing 11. Also, disassembling and separating of the door lock at an outdoor side may be prevented and thus a trespass from an outside may be prevented.

The body 8 linearly reciprocates along the inner wall of the body housing 11 by the external force which pushes or pulls the handles 1*a* and 1*b*. At this time, the connecting shaft 5 reciprocates along the inclined surface 15. At this time, the inclined surface 15 is formed in a flat surface or a curved surface so that the slider 7 of the latch bolt assembly 80 may be moved in the axial direction of the connecting shaft 5. The first embodiment has described an example in which the inclined surface 15 is formed in a V-shaped cut-away groove. The connecting shaft 5 of the latch bolt assembly 80 reciprocates between a settling point 18 of the inclined surface 15 forming the V-shaped cut-away groove of the body 8 and two apexes 19, and enables the slider 7 to be continuously in contact with the sliding inclined surface 15 formed at the body 8. The sliding inclined surface 15 on which the slider 7 is moved is exposed to an outside, and a moving space of the slider 7 is opened when being seen from a side surface of the body 8.

Here, the body moving space 9 having the oval or rectangular cross sectional shape vertical to the inclined surface 15 forming the V-shaped cut-away groove and formed vertically to the connecting shaft 5 is formed at the center portion of the body 8 so that the connecting shaft 5 is interlocked with the reciprocating motion of the body 8 and moved vertically to the moving direction of the body 8.

A width of the body moving space 9 is slightly greater than a diameter of the connecting shaft 5 and a major axis thereof, which is twice or more of a displacement of the latch bolt 2, has the oval or rectangular cross sectional shape, such that the connecting shaft 5 may linearly reciprocate vertically to the linear reciprocating motion of the body 8 while being maintained in a state of passing through the body moving space 9.

Figure 4:
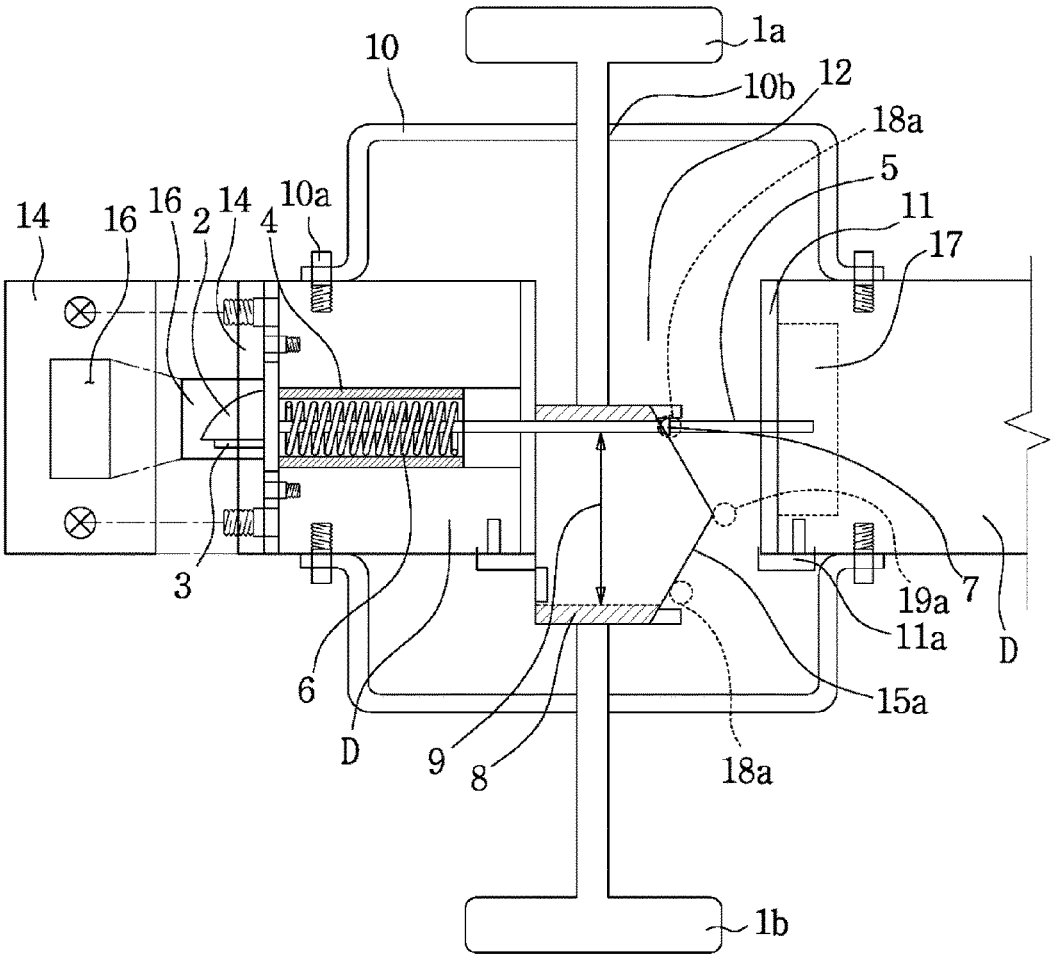
FIG. 4 is a schematic view illustrating a state in which a safety door lock according to a second embodiment of the present invention is closed.
Figure 6:
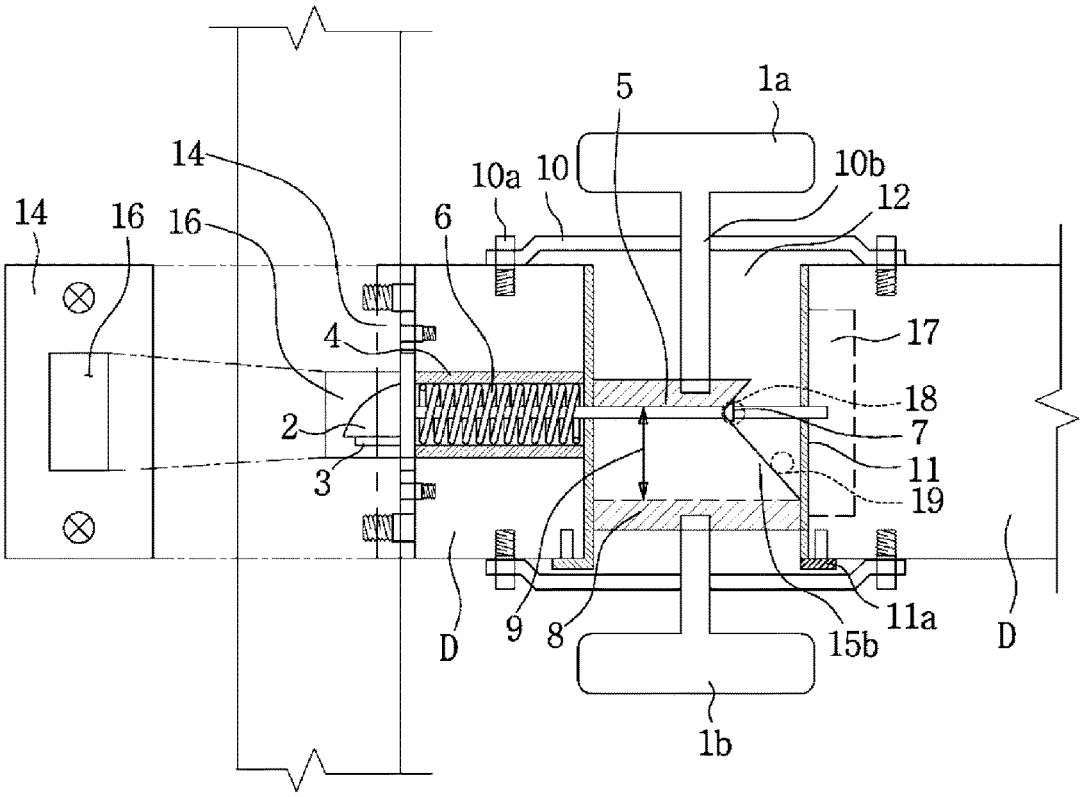
FIG. 6 is a schematic view illustrating a state in which a safety door lock according to a third embodiment of the present invention is closed.
Figure 7:
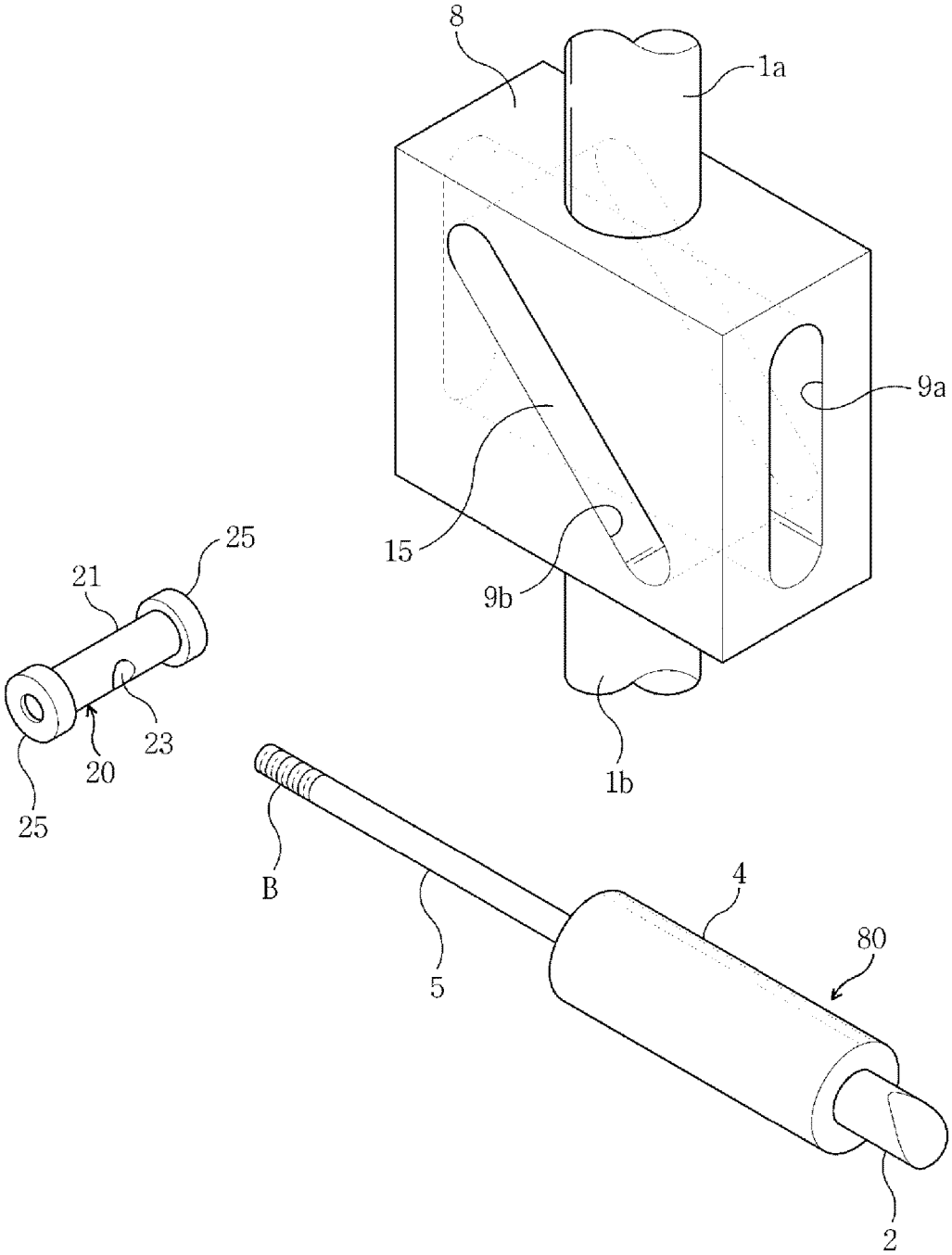
FIG. 7 is an exploded perspective view illustrating a closed force transmission device according to a fourth embodiment of the present invention.

Here, the inclined surface of the body 8 may be formed in the V-shaped groove, as illustrated in FIGS. 1 and 2, may be formed in a reversed V-shaped protrusion, as illustrated in FIG. 4 or 6, or may be formed in a single inclined surface, as illustrated in FIG. 7.

The inclined surface 15 is provided in one pair opposite to each other, and it is preferable that one ends thereof are in contact with each other to form a predetermined angle. In this case, the pair of inclined surfaces may be formed in the V-shaped cut-away groove (referring to FIGS. 1 and 2), or may be formed in the reversed V-shaped protrusion (referring to FIGS. 4 and 5). At this time, the angle defined by the pair of inclined surfaces may be 30 to 160°.

In this case, if the angle of the sliding inclined surfaces 15 and 15*a* of the body is reduced, and a height between the settling point (an initial position) and the apexes is increased, the displacement of the connecting shaft with respect to the same moving distance of the body may be increased, and thus the insertion depth of the latch bolt inserted into the latch bolt insertion groove may be deep.

Further, an inclined surface 15*b* of FIG. 6 may be formed in the single inclined surface having only one surface. At this time, the single inclined surface may form an angle of 15 to 75°.

Meanwhile, if an elastic repulsive force of the elastic body 6 with respect to the same angle of the body sliding inclined surfaces 15, 15*a*, and 15*b* is reduced, the force which pushes and pulls the connecting shaft may be reduced, and thus a user's convenience may be enhanced by combining the angle of the sliding inclined surfaces 15, 15*a*, and 15*b* and the elastic repulsive force of the elastic body 6. That is, the elastic body having a small elastic force may be used in the door lock mainly used by children or the old and weak, and the elastic body having a large elastic force may be used in the door lock mainly used by adults.

The body 8 may be machined using a material having various cross sectional shapes such as a board, a rod, a square timber, and a pipe.

The latch bolt assembly 80 serves to convert the linear reciprocating motion of the body 8 into the vertical reciprocating motion and thus to enable the latch bolt 2 to be inserted into or separated from the latch bolt insertion groove 16. The latch bolt assembly 80 includes the connecting shaft 5, the latch bolt 2, the elastic body 6, and the latch case 4, and one end of the connecting shaft 5 is connected with the slider 7, and the other end thereof is connected with the latch bolt 2.

The latch bolt 2 and a guide bolt 3 are connected with the other end of the connecting shaft 5 to be inserted into or separated from the latch bolt insertion groove 16 according to the reciprocating motion of the connecting shaft 5, and thus to allow the door D to be opened and closed. The latch bolt 2 and a guide bolt 3 are received in the latch case 4 together with the connecting shaft 5 and the elastic body 6.

The latch bolt of the door lock on the market may be inserted into the latch bolt insertion groove 16 in a maximum depth of 15 mm. However, in the latch bolt 2 of the present invention, the insertion depth may be adjusted in a depth of 15 mm or more according to the angle of the sliding inclined surface 15 and the moving distance of the body 8.

Further, for example, even when the male screw is formed at the connecting shaft 5, the female screw is formed at the latch bolt 2, and the latch bolt 2 is connected with the connecting shaft 5, the insertion depth of the latch bolt 2 inserted into the latch bolt insertion groove 16 may be deep.

Therefore, if the insertion depth of the latch bolt 2 inserted into the latch bolt insertion groove 16 is deep through such a method, it is difficult to separate the latch bolt from the latch bolt insertion groove using a tool such as a screw driver, and thus the safety door lock may be provided.

Meanwhile, the elastic body 6 may be fabricated using a material having elasticity, such as a coil spring, a leaf spring, and rubber.

Further, the connecting shaft guide 17 may be formed at the door to prevent shaking of the connecting shaft 5 and to stably reciprocate the connecting shaft 5, when the connecting shaft 5 reciprocates vertically to the moving direction of the body 8.

The slider 7 is continuously in contact with the inclined surface 15 and serves to enable the connecting shaft 5 to reciprocate vertically to the reciprocating motion of the body 8. A method of connecting the slider 7 with the connecting shaft 5 may include various manners such as a welding. As illustrated in FIG. 3, when a bolt B and a nut N are used in the connecting method, the insertion length of the latch bolt 2 inserted into the latch bolt insertion groove 16 may be adjusted, as described above.

The holder 10 serves to protect the body 8 and other construction components from the external force outside the door D and also to prevent separation of the construction components. The holder 10 is fixed to the door D by the holder fixing means 10*a*. Further, the handles 1*a* and 1*b* pass through a holder hole 10*b* formed at a center portion of the holder.

An operation of the door lock according to the present invention as described above will be described below.

Firstly, when the door D is closed and no external force is applied to the handles 1*a* and 1*b* or the door D, as illustrated in FIG. 1, the body 8 is located at a center portion of the body housing 11, and the slider 7 is located at the settling point 18 of the V-shaped groove of the body 8. At this time, the latch bolt 2 connected to the connecting shaft 5 protrudes outside the door D and is inserted into the latch bolt insertion groove 16 formed at a strike plate 14, and thus the door D may be maintained in a closed state.

Referring to FIG. 2, if a user pushes the handle 1*a* using his/her body such as an arm, the body 8 is moved from the center portion of the body housing 11 to an outside, and the slider 7 is moved up along the sliding inclined surface 15 of the V-shaped groove of the body 8 from the settling point 18 of the body 8 to the apex 19 of the side surface, and thus the connecting shaft 5 connected with the slider 7 is moved toward the connecting shaft guide 17, and the elastic body 6 is contracted. Therefore, the protruding latch bolt 2 is separated from the latch bolt insertion groove 16 and received in the latch case 4.

While the latch bolt 2 is received in the latch case 4 as described above, the door D is easily opened by the external force with which the user pushes or pulls the door.

However, the latch bolt of the door lock on the market may be inserted into the latch bolt insertion groove 16 in a maximum depth of 15 mm. However, in the latch bolt 2 of the present invention, the insertion depth may be adjusted in a depth of 15 mm or more according to the angle of the sliding inclined surface 15 and the moving distance of the body 8.

That is, the angle of the body sliding inclined surface 15 formed at the body 8 has the range of 30 to 160°. If the angle of the sliding inclined surface 15 of the body is reduced and the height between the settling point and the apexes is increased, the displacement of the connecting shaft may be increased, and thus the insertion depth of the latch bolt inserted into the latch bolt insertion groove may be deep. Therefore, it is difficult to separate the latch bolt from the latch bolt insertion groove using the tool such as the screw driver, and thus the safety door lock which does not need a double locking device may be provided.

On the contrary to this, when the user releases the external force pushing the handle 1*a* after the door D is opened, the body 8 is returned to the center portion of the body housing 11 by the elastic force of the elastic body 6, and the slider 7 moved up to the apex 19 is moved down along the sliding inclined surface 15 of the body 8 and returned to the settling point 18, and the latch bolt 2 protrudes from the latch case 4 and is returned to the state of FIG. 1, and thus the door D is in a locked state.

Figure 5:
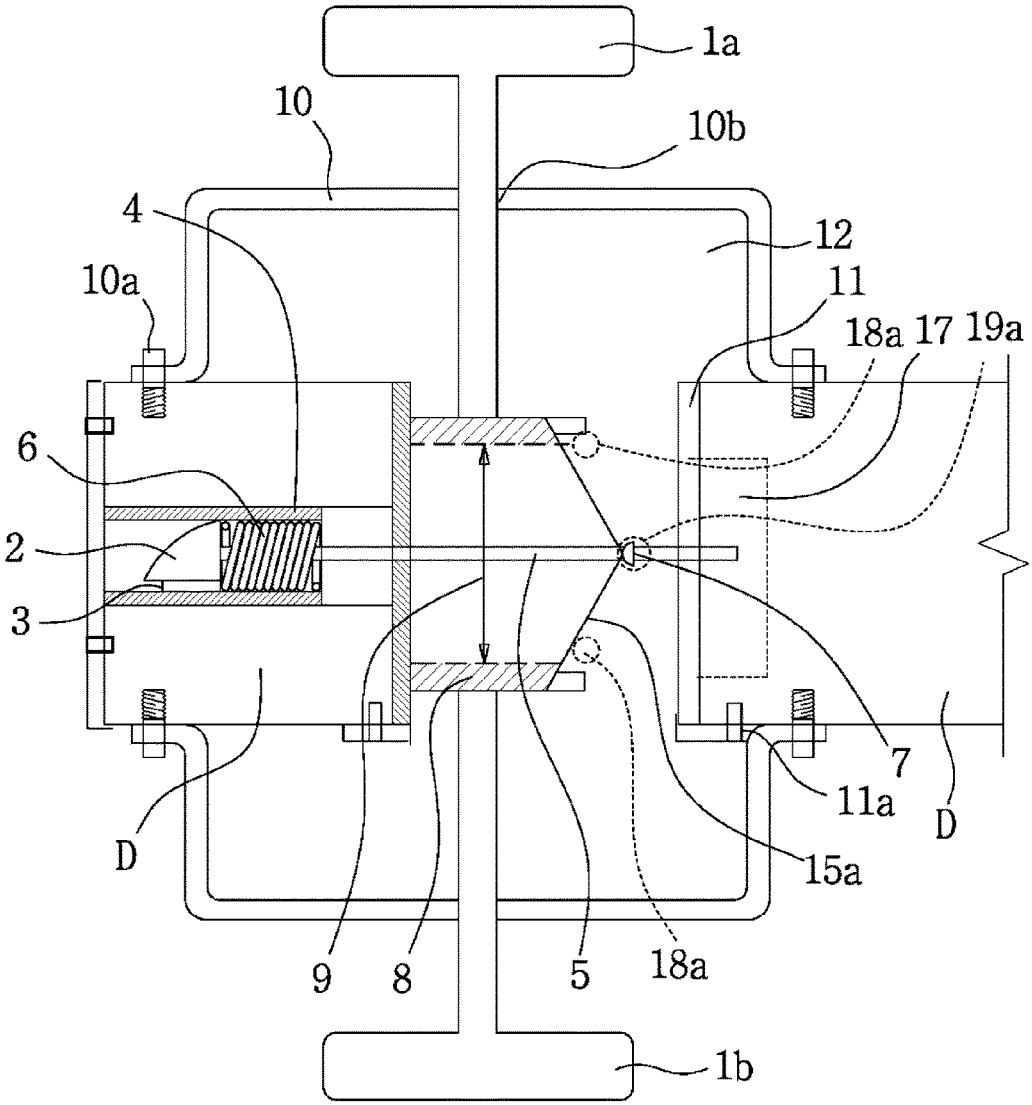
FIG. 5 is a schematic view illustrating a state in which the safety door lock of FIG. 4 is opened.

FIG. 4 is a schematic view illustrating a state in which a safety door lock according to a second embodiment of the present invention is closed, and FIG. 5 is a schematic view illustrating a state in which the safety door lock of FIG. 4 is opened.

The second embodiment of the present invention has the same configuration and operation as the first embodiment, except a difference in which the sliding inclined surface 15*a* formed at the body 8 is formed in the reversed V-shape, and thus will be briefly described.

Referring to FIGS. 4 and 5, in a state in which the door D is closed, the body 8 is located at an outer side of the body housing, and the slider 7 is located at a settling point 18*a* of the body by the elastic force of the elastic body 6, as illustrated in FIG. 4. At this time, the latch bolt 2 connected with the slider 7 via the connecting shaft 5 protrudes outside the door D, and is inserted into the latch bolt insertion groove 16 formed at the strike plate 14, and thus the door D is maintained in the closed state.

In this state, if the user pushes the handle 1*b* using his/her body such as an arm, as illustrated in FIG. 5, the body 8 is moved from the outside to the center portion of the body housing 11, and the slider 7 is moved up along the sliding inclined surface 15*a* of the body 8 from the settling point 18*a* to an apex 19*a*, and thus the connecting shaft 5 connected with the slider 7 is moved toward the connecting shaft guide 17 of FIG. 5, and the elastic body 6 is contracted.

Therefore, the protruding latch bolt 2 is separated from the latch bolt insertion groove 16 and received in the latch case 4. While the latch bolt 2 is received in the latch case 4 as described above, the door D is easily opened by the external force with which the user pushes the door.

Similarly, in the inverse case, the body 8 is returned to the outside of the body housing, and the slider 7 located at the apex 19*a* is returned to the settling point 18*a* along the inclined surface 15*a* of the body 8, and the latch bolt 2 protrudes to the outside of the door D, and thus the door D is in the locked state.

FIG. 6 is a schematic view illustrating a state in which a safety door lock according to a third embodiment of the present invention is closed.

The third embodiment of the present invention has the same configuration and operation as the first and second embodiments, except a difference in which the sliding inclined surface 15*b* formed at the body 8 is formed in the single inclined surface, and thus will be briefly described.

When considering costs, engineering plastics, nonferrous metals, ferrous metals, or the like may be used as a material of each construction component to smoothly perform the above functions and to increase durability thereof, and various fabricating processes may be applied to the construction components.

The door lock according to the present invention may allow the insertion depth of the latch bolt to be deep, thereby enhancing the safety, and thus persons with physical handicap and reduced mobility, such as disabled persons, patients, and old persons, as well as normal persons may easily open and close the door.

Further, the fabricating cost is low due to its simple structure, and the present invention may be also installed at the door using the cylindrical or tubular door lock without an additional reconstruction work and may use variously designed handles.

Figure 8:
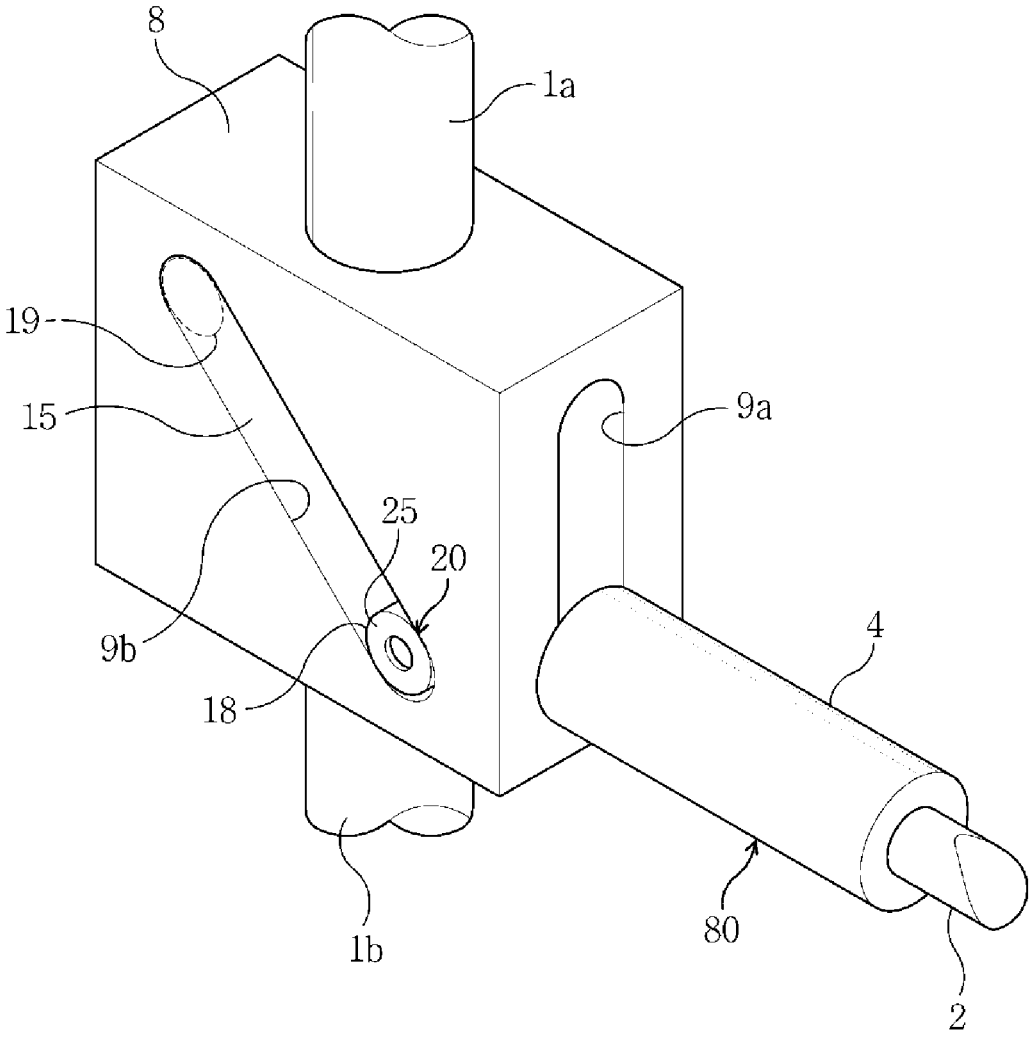
FIG. 8 is a perspective view illustrating a state in which a body and the force transmission device of FIG. 7 are assembled.
Figure 9:
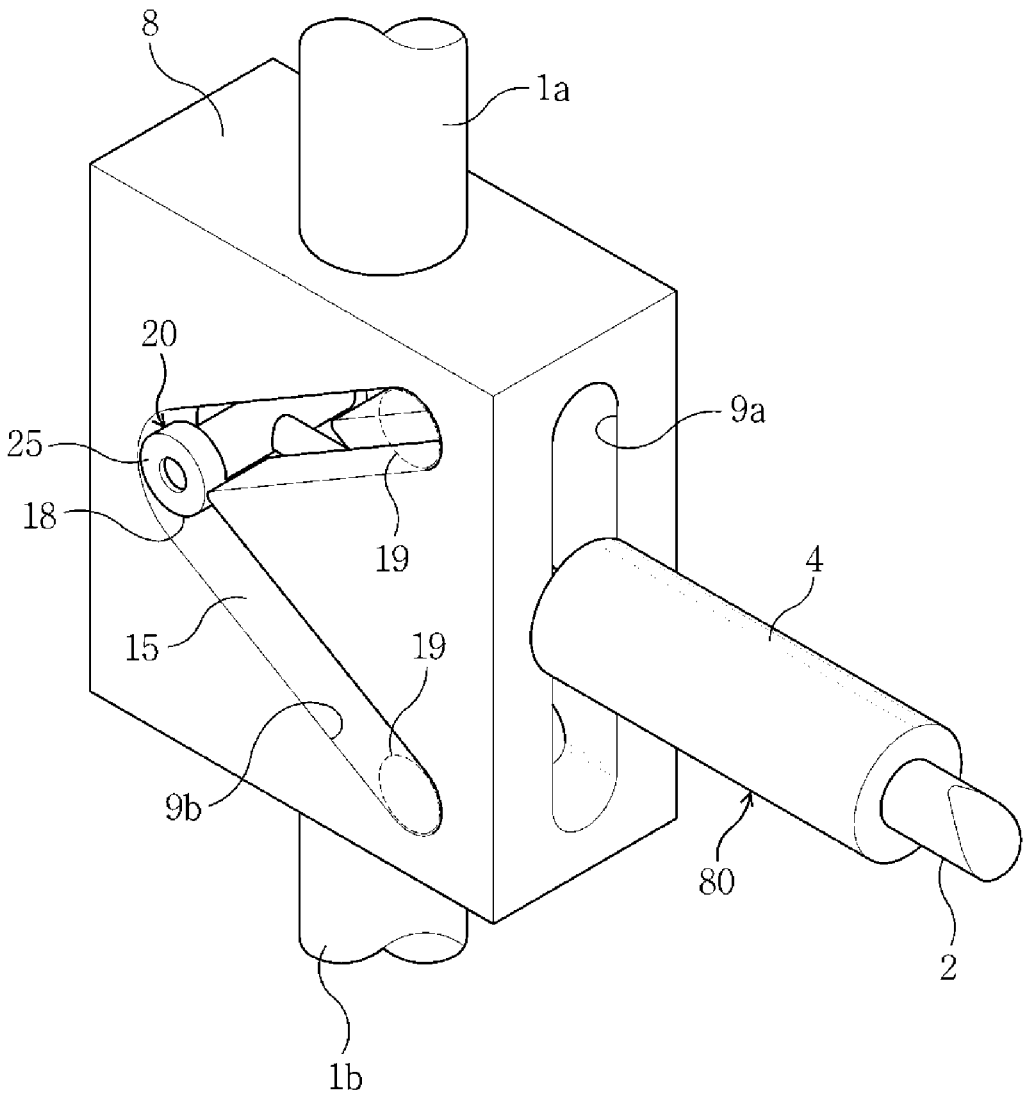
FIG. 9 is a perspective view illustrating a state in which a closed force transmission device according to a fifth embodiment of the present invention is assembled.

Meanwhile, the first to third embodiments have described an example in which the inclined surface 15 is formed at one side surface of the body 8, but are not limited thereto. For example, as illustrated in FIGS. 7 to 9, the inclined surface 15 may be formed in the body 8. That is, the body 8 according to the first to third embodiments has an opened structure in which the inclined surface 15 is exposed to one side surface, and the body 8 according to the fourth to seventh embodiments has an closed structure in which the inclined surface 15 is formed at an inside.

FIG. 7 is an exploded perspective view illustrating the body 8 and the latch bolt assembly 80 of a closed force transmission device according to the fourth embodiment of the present invention. FIG. 8 is a perspective view illustrating a state in which the body 8 and the latch bolt assembly 80 of the closed force transmission device of FIG. 7 are assembled. Here, FIGS. 7 and 8 illustrate only the body 8 and latch bolt assembly 80 in the safety door lock according to the fourth embodiment, and the other structures may have the same configurations as those in the safety door lock according to the first to third embodiments.

The body 8 has the inclined surface 15 formed therein. The inclined surface 15 is formed by an inner surface of a linear hole. That is, first and second body moving spaces 9*a* and 9*b* as body moving spaces 9*a* and 9*b* are formed at the body 8. The first body moving space 9*a* is formed in a slot shape to be parallel with a sliding movement direction in the body housing. The second body moving space 9*b* is formed to be connected with the first body moving space 9*a*, and formed in the slot shape to be inclined with respect to the sliding movement direction in the body housing, and the inner surface thereof is used as the inclined surface 15.

The body 8 includes a first surface connected with the first handle 1*a*, a second surface opposite to the first surface and connected with the second handle 1*b*, a third surface adjacent to the first and second surfaces, a fourth surface opposite to the third surface, a fifth surface adjacent to the third and fourth surfaces, and a sixth surface opposite to the fifth surface. The first body moving space 9*a* is formed to vertically pass through the third and fourth surfaces, and formed in the slot shape to be parallel with the sliding movement direction in the body housing. The second body moving space 9*b* is formed to pass through the fifth and sixth surfaces, and formed in the slot to be inclined with respect to the sliding movement direction in the body housing, and the inner surface of the second body moving space 9*b* is used as the inclined surface 15. Positions of both ends of the first and second body moving spaces 9*a* and 9*b* are formed to be substantially the same, such that the body 8 guides a stable movement of the latch bolt assembly 80. The fourth embodiment describes an example in which the second body moving space 9*b* is formed in a linear shape.

Meanwhile, the body 8 linearly reciprocates along the inner wall of the body housing by the external force which pushes or pulls the handles 1*a* and 1*b*. At this time, the connecting shaft 5 reciprocates between the settling point 18 and the apex 19 of the inclined surface 15 of the body 8, and allows a slider 20 to be continuously in contact with the sliding inclined surface 15 formed at the body 8. At this time, the settling point 18 and the apex 19 may be located at the both ends of the second body moving space 9*b*. The settling point 18 is located to be adjacent to a latch guide 4.

The latch bolt assembly 80 includes the slider 20, the connecting shaft 5, the elastic body, and the latch bolt 2. Since the elastic body and the latch bolt 2 installed at the latch guide 4 has the same configurations as those in the first to third embodiments, detailed description thereof will be omitted, and the slider 20 and the connecting shaft 5 will be mainly described.

Here, the elastic body may be installed at at least one of both ends of the body housing, and may be installed to be coupled with the latch bolt 2.

The slider 20 is installed at the second body moving space 9*b* of the body 8, and moved along the second body moving space 9*b*, and a coupling hole 23 is formed at a portion in which the first and second body moving spaces 9*a* and 9*b* are crossed. The slider 20 includes a slider rod 21 in which the coupling hole 23 is formed, and one pair of bearings 25 coupled to both ends of the slider rod 21 and moved along the inclined surface 15 of the second body moving space 9*b* of the body 8.

The connecting shaft 5 is movably installed to pass through the body 8 and the body housing, and installed to pass through the first body moving space 9*a* of the body 8. The connecting shaft 5 is coupled and fixed into the coupling hole 23 of the slider 20.

The safety door lock according to the fourth embodiment as described above is operated as follows. That is, if the handles 1*a* and 1*b* are pushed or pulled, the slider 20 is moved along the inclined surface 15, and interlockingly moves the latch bolt 2 to an inner sider of the latch guide 4. And if the force which pushes or pulls the handles 1*a* and 1*b* is released, the latch bolt 2 protrudes outside the latch guide 4 due to the elastic force of the elastic body installed at the latch guide 4. That is, the safety door lock according to the fourth embodiment is operated in the same manner as that according to the third embodiment, except that the inclined surface 15 is formed in the body 8.

Meanwhile, the fourth embodiment has described an example in which the second body moving space 9*b* is formed in the linear shape, but is not limited thereto. For example, the second body moving space 9*b* may have at least one curved portion. That is, as illustrated in FIG. 9, the second body moving space 9*b* of the safety door lock according to the fifth embodiment is formed by an inner surface of a V-shaped hole.

The body 8 linearly reciprocates along the inner wall of the body housing by the external force which pushes or pulls the handles 1*a* and 1*b*. At this time, the connecting shaft 5 reciprocates between the settling point 18 and two apexes 19 of the V-shaped inclined surface 15 of the body 8, and allows the slider 20 to be continuously in contact with the sliding inclined surface 15 formed at the body 8. At this time, the settling point 18 may be located at a valley portion of the V-shaped inclined surface 15, and the apexes may be located at both ends of the V-shaped inclined surface 15.

In the embodiment, a protruding portion of the second body moving space 9*b* is formed at a side distant from a surface at which the latch guide 4 is installed, but may be formed at a reverse side adjacent to the surface, like the first embodiment.

As described above, the safety door lock according to the fifth embodiment is operated in the same manner as that according to the second embodiment, except that the inclined surface 15 is formed in the body 8.

Figure 10:
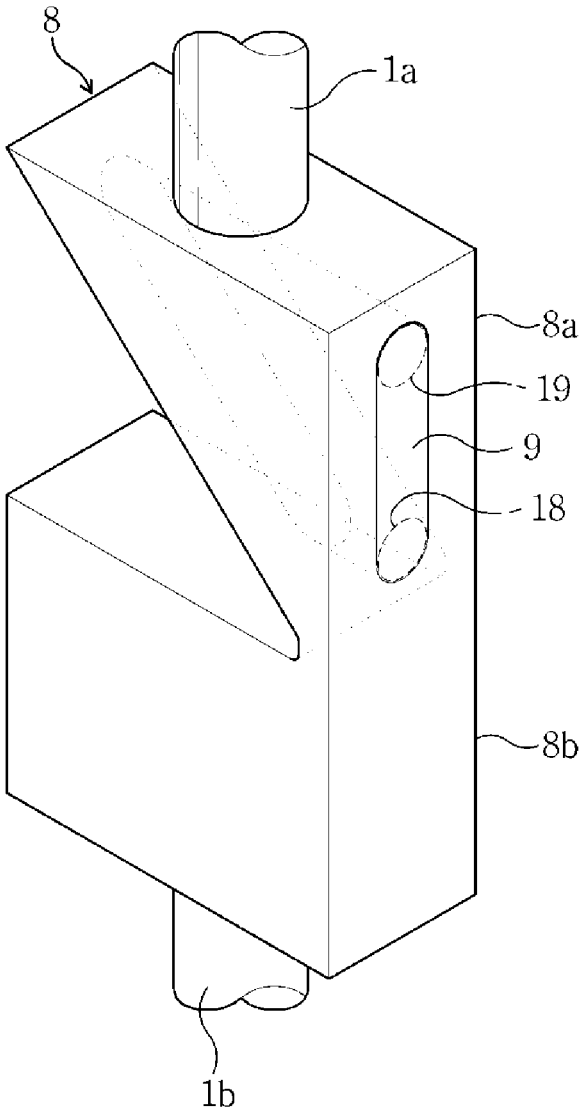
FIG. 10 is a perspective view illustrating a body according to a sixth embodiment of the present invention.
Figure 11:
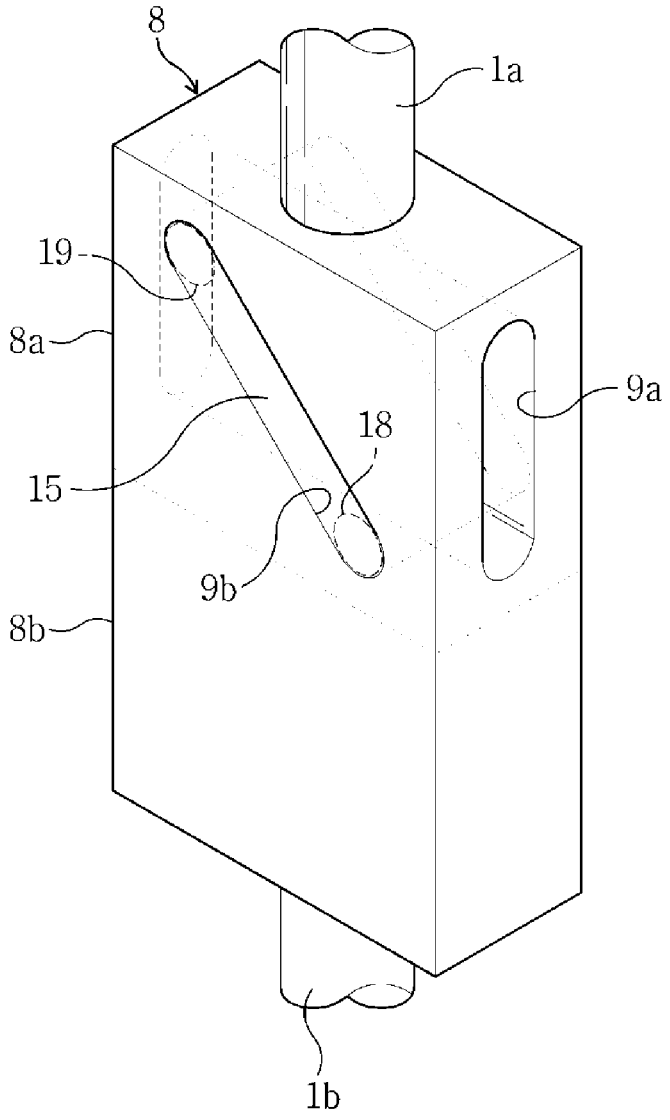
FIG. 11 is a perspective view illustrating a body according to a seventh embodiment of the present invention.

Meanwhile, each body 8 of the safety door locks according to the third and fourth embodiments as described above may be modified into a body 8 as illustrated in FIGS. 10 and 11. That is, referring to FIG. 10, a safety door lock according to a sixth embodiment may be used in only one direction using the handles 1*a* and 1*b*, and may include a subsidiary body 8*b* configured to install the handles 1*a* and 1*b* to be symmetrical to each other with respect to the body 8.

The body 8 may include a main body 8*a* in which the body moving space 9 is formed, and the subsidiary body 8*b* connected with the main body 8*a*. The first handle 1*a* may be connected with the main body 8*a*, and the second handle 1*b* may be connected with the subsidiary body 8*b*.

At this time, the settling point 18 and the apex 19 may be located at the both ends of the body moving space 9. The settling point 18 is installed to a side adjacent to the latch guide. That is, the settling point 18 is installed to a side adjacent to a portion connected with the subsidiary body 8*b*.

Referring to FIG. 11, a safety door lock according to a seventh embodiment may be used in only one direction using the handles 1*a* and 1*b*, and may include a subsidiary body 8*b* configured to install the handles 1*a* and 1*b* to be symmetrical to each other with respect to the body 8.

The body 8 may include a main body 8*a* in which the body moving spaces 9*a* and 9*b* are formed, and the subsidiary body 8*b* connected with the main body 8*a*. The first handle 1*a* may be connected with the main body 8*a*, and the second handle 1*b* may be connected with the subsidiary body 8*b*.

At this time, the settling point 18 and the apex 19 may be located at the both ends of the second body moving space 9*b*. The settling point 18 is installed to the side adjacent to the latch guide. That is, the settling point 18 is installed to a side adjacent to a portion connected with the subsidiary body 8*b*.

In this specification, exemplary embodiments of the present invention have been classified into the first, second and third exemplary embodiments and described for conciseness. However, respective steps or functions of an exemplary embodiment may be combined with those of another exemplary embodiment to implement still another exemplary embodiment of the present invention.

What is claimed is:

1. A closed safety door lock comprising:

a body housing of which two side surfaces are opened, wherein the body housing is cylindrical so as to pass through a door;

a body slidably installed in the body housing so as to be linearly moved in a linear moving direction by an external force, and having at least one inclined surface, a first body moving space having a slot shape that extends parallel with the linear moving direction of the body, and a second body moving space having a slot shape and is connected with the first body moving space, wherein the slot shape of the second body moving space is inclined with respect to the linear moving direction of the body, and wherein the at least one inclined surface is formed as at least one inner surface of the second body moving space;

first and second handles connected with the body through the body housing so as to protrude out from either side surface of the door, respectively; and a latch bolt assembly of which one end passes through the first body moving space and is coupled such that at least one portion of the latch bolt assembly is moved perpendicularly to the linear moving direction of the body along the at least one inclined surface, and another end of the latch bolt assembly is elastically supported to the body housing so as to be interlocked with the linear movement of the body such that the at least one portion of the latch bolt assembly is moved perpendicularly to the linear moving direction of the body, wherein the body comprises:

a first surface connected with the first handle;

a second surface opposite to the first surface and connected with the second handle;

a third surface adjacent to the first and second surfaces;

a fourth surface opposite to the third surface;

a fifth surface adjacent to the third and fourth surfaces; and a sixth surface opposite to the fifth surface, and wherein the first body moving space is formed so as to horizontally pass through the third and fourth surfaces, and the second body moving space is formed to pass through the fifth and sixth surfaces.

2. The safety door lock of claim 1, wherein the body and the at least one portion of the latch bolt assembly are returned to original positions when the external force applied to the body is released.

3. The safety door lock of claim 1, wherein the latch bolt assembly comprises:

a connecting shaft movably installed to pass through the body and the body housing;

a slider coupled to one side of the connecting shaft so as to move in an axial direction of the connecting shaft while being in contact with the at least one inclined surface at a time of the linear movement of the body and thus moves the connecting shaft in a direction perpendicular to the linear moving direction of the body;

an elastic body configured to elastically support another side of the connecting shaft and to return the body and the at least one portion of the latch bolt assembly to original positions when the external force applied to the body is released; and a latch bolt installed at an end of the other side of the connecting shaft to reciprocate in the axial direction of the connecting shaft according to a restoring force of the elastic body and to maintain a locked or unlocked state of the door, wherein the at least one portion of the latch bolt assembly that moves perpendicularly to the linear moving direction of the body comprises at least the connecting shaft, the slider, and the latch bolt of the latch bolt assembly.

4. The safety door lock of claim 1, wherein a cross section of the first body moving space has a circular or rectangular shape, a width thereof is greater than a diameter of the connecting shaft, and a length thereof is formed so as to be twice or more of a displacement of the connecting shaft.

5. The safety door lock of claim 1, wherein the at least one inclined surface is formed into a single inclined surface or a pair of inclined surfaces opposed to each other, wherein ends thereof are in contact with each other to form a predetermined angle.

6. The safety door lock of claim 5, wherein the pair of inclined surfaces are formed in a V-shaped cut-away groove.

7. The safety door lock of claim 5, wherein the single inclined surface forms an angle of 15 to 75°, and the pair of inclined surfaces form an angle of 30 to 160°.

8. The safety door lock of claim 3, wherein a portion of the slider, which is in contact with the at least one inclined surface, is formed in an arc shape.

9. The safety door lock of claim 3, wherein the displacement of the connecting shaft is in inverse proportion to an inclined angle of the at least one inclined surface, and is in proportion to a height between an initial position and an apex position on the at least one inclined surface of the body.

10. The safety door lock of claim 3, further comprising a latch case configured to receive the latch bolt therein when the elastic body is contracted.

11. The safety door lock of claim 1, wherein the second body moving space is formed in a linear shape.

12. The safety door lock of claim 11, wherein the body comprises:

a main body in which the first and second body moving spaces are formed and which is connected with the first handle; and a subsidiary body integrally formed with the main body and connected with the second handle.

13. The safety door lock of claim 12, wherein the at least one portion of the latch bolt assembly switches the door into a locked or unlocked state when the latch bolt assembly is located at either end of the second body moving space.

14. The safety door lock of claim 11, wherein the second body moving space has at least one curved portion.

15. The safety door lock of claim 11, wherein two ends of the first and second body moving spaces are substantially the same.

16. The safety door lock of claim 11, wherein the latch bolt assembly comprises:

a slider installed at the second body moving space of the body so as to be moved along the second body moving space, and having a coupling hole formed at a portion in which the first and second body moving spaces are crossed;

a connecting shaft movably installed to pass through the body and the body housing, and installed to pass through the first body moving space of the body, so as to be fixed to the coupling hole of the slider at one side;

an elastic body configured to elastically support another side of the connecting shaft and to provide a restoring force to return the body and the latch bolt assembly to original positions when the external force applied to the body is released; and a latch bolt installed at an end of the other side of the connecting shaft to reciprocate in an axial direction of the connecting shaft according to the restoring force of the elastic body and to maintain a locked or unlocked state of the door, wherein the at least one portion of the latch bolt assembly that moves perpendicularly to the linear moving direction of the body comprises at least the connecting shaft, the slider, and the latch bolt of the latch bolt assembly.

17. The safety door lock of claim 16, wherein the slider comprises:

a slider rod in which the coupling hole is formed; and a pair of bearings coupled to either end of the slider rod so as to move along the at least one inclined surface of the second body moving space of the body when the external force is applied to the body.

18. A closed force transmission device comprising:

a body slidably installed in a body housing so as to be linearly moved in a linear moving direction by an external force, and having at least one inclined surface, a first body moving space having a slot shape that extends parallel with the linear moving direction of the body, and a second body moving space having a slot shape and is connected with the first body moving space, wherein the slot shape of the second body moving space is inclined with respect to the linear moving direction of the body, and wherein the at least one inclined surface is formed as at least one inner surface of the second body moving space; and a latch bolt assembly of which one end passes through the first body moving space and is coupled such that at least one portion of the latch bolt assembly is moved perpendicularly to the linear moving direction of the body along the at least one inclined surface, and another end of the latch bolt assembly is elastically supported to the body housing so as to be interlocked with the linear movement of the body such that the at least one portion of the latch bolt assembly is moved perpendicularly to the linear moving direction of the body, wherein the body comprises:

a first surface to which the external force can be applied;

a second surface opposite to the first surface and to which the external force can be applied;

a third surface adjacent to the first and second surfaces;

a fourth surface opposite to the third surface;

a fifth surface adjacent to the third and fourth surfaces; and a sixth surface opposite to the fifth surface, and the first body moving space is formed so as to horizontally pass through the third and fourth surfaces, and the second body moving space is formed to pass through the fifth and sixth surfaces.

* * * * *